United States Patent [19]

Reynolds

[11] 4,103,746

[45] Aug. 1, 1978

[54] ROTARY AND PERCUSSIVE DEVICES

[75] Inventor: Lionel Arthur Reynolds, Painswick, England

[73] Assignee: A. F. Hydraulics Limited, Chequers Bridge, England

[21] Appl. No.: 750,161

[22] Filed: Dec. 13, 1976

[30] Foreign Application Priority Data

Dec. 23, 1975 [GB] United Kingdom ..... 52761/75

[51] Int. Cl.[2] ..... B25D 9/00

[52] U.S. Cl. ..... 173/107

[58] Field of Search ..... 173/106, 107, 104, 105, 173/108

[56] References Cited

U.S. PATENT DOCUMENTS

| | | | |
|---|---|---|---|
| 1,464,809 | 8/1923 | Curti | 173/107 |
| 1,605,715 | 11/1926 | Gilman | 173/107 |
| 2,457,969 | 1/1949 | Anderson | 173/107 |
| 3,406,763 | 10/1968 | Worman | 173/107 |
| 3,584,695 | 6/1971 | Turnbull | 173/107 |
| 3,741,316 | 6/1973 | Alajouanine | 173/107 |

FOREIGN PATENT DOCUMENTS

| | | | |
|---|---|---|---|
| 1,056,946 | 11/1965 | United Kingdom | 173/106 |

*Primary Examiner*—Robert A. Hafer

*Attorney, Agent, or Firm*—Cushman, Darby & Cushman

[57] ABSTRACT

A hydraulic rotary and percussive device, for example a hand-held hammer or a rock drill, comprises hydraulic reciprocatory percussive means and hydraulic rotary drive means. The means are connected in series hydraulically with the rotary drive means on the exhaust side of the reciprocatory percussive means. The rotary drive means comprise a drive motor actuated by an exhaust pressure pulse on the return stroke of the reciprocatory percussive means, a rotary bush in which a tool is received and a ratchet mechanism coupling the motor to the bush. Valve means are provided by which the rotary drive means can selectively be rendered operative or inoperative.

9 Claims, 4 Drawing Figures

ROTARY AND PERCUSSIVE DEVICES

FIELD OF THE INVENTION

This invention relates to hydraulic percussive devices employing a reciprocatory piston/striker arrangement to act on a tool, for example a rock drill, and embodying rotary drive means by which the tool may be rotated.

BACKGROUND OF THE INVENTION

The hydraulic reciprocatory percussive means and the hydraulic rotary drive means are normally connected in parallel hydraulically, which requires flow splitting valve arrangements which have to proportion the power between the reciprocatory percussive means and the rotary drive means. Such valve arrangements, particularly with a device the percussive section of which is sensitive to flow and/or pressure conditions, can be complex. In addition power may be wasted, for example with a restrictor in series with the rotary drive means to reduce the pressure applied thereto. It is an object of the invention to provide a device which obviates the need for such complex valve arrangements, and which rotates the tool intermittently on the rebound strokes thereof.

It is a characteristic of hydraulic percussive devices that there is a considerable feed back of energy at the commencement of the exhaust stroke. The resilience of the tool and striker produces rebound with a high pressure pulse at the commencement of the exhaust stroke, and this energy is normally dissipated by a restrictor which provides a back pressure which also controls the reciprocating frequency. A further object of the invention is to employ this normally wasted energy, or a portion thereof, to power the rotary drive means.

SUMMARY OF THE INVENTION

According to the invention a percussive device comprises hydraulic reciprocatory percussive means and hydraulic rotary drive means connected in series hydraulically with the rotary drive means on the exhaust side of the reciprocatory percussive means.

Arranging the rotary drive means in series with and on the exhaust side of the reciprocatory means utilises the exhaust energy which is normally wasted, and the arrangement can be such that the normal exhaust restrictor is dispensed with, or reduced. Further advantages which stem from the invention are that flow splitting valve arrangements are not required, in contrast to the existing devices in which the percussive and rotary drive means are disposed in parallel hydraulically, and that the rotary drive is operative on the exhaust stroke of the percussive action. Thus the working tool is turned during its rebound phase, when the power required to turn it is a minimum, and the cutting faces of the tool are repositioned ready for the next forward working stroke.

Valve means may be provided by which the rotary drive means can selectively be rendered operative or inoperative. These valve means may be arranged to by-pass the rotary drive means by a restrictor chosen to control the reciprocatory frequency appropriately when the rotary drive is not employed.

A flow restrictor may be arranged in parallel with the rotary drive means, the degree of restriction determining the proportion of the exhaust pulse energy which is converted into rotary energy. A fixed parallel restrictor may be built into a rotary drive motor, and when the latter is a piston motor the restrictor may be a by-pass channel in the piston itself or the wall of the cylinder in which the piston reciprocates.

When the device is part of a self-contained system with its own hydraulic power source, the device will normally operate under constant flow conditions. In this case the percussive action and particularly the frequency thereof is sensitive to exhaust characteristics, and efficient operation requires that these characteristics be kept more or less constant. Thus a by-pass restrictor, if provided, will in general be a fixed restrictor chosen to provide the appropriate exhaust characteristics.

However, when the device operates from a pressure gallery and hence under constant pressure conditions as will occur, for example, in mining applications, a variable by-pass restrictor can be employed. This enables the rotary power to be adjusted to suit requirements, and in particular provides control of the percussive frequency inversely with respect to the rotary torque and speed. Thus a reduction in percussive energy is accompanied by an increase in rotary power, and vice versa.

The rotary drive means may include a rotary bush providing or embodied in the tool holder, and this bush may be rotated stepwise through a ratchet mechanism driven by a piston motor. Alternatively a gear motor may be employed to produce a stepwise rotation on each exhaust pulse.

In a preferred embodiment employing a piston motor, the motor stroke is limited by the uncovering of an exhaust port, the stroke being chosen to utilise the high pressure rebound exhaust pulse which normally represents waste energy and/or the exhaust port to be uncovered so that the normal low pressure exhaust flow is not utilised for rotary driving. Thus the normally waste energy is usefully employed, but the normal reciprocatory drive exhaust is not impeded. This is particularly advantageous with a reciprocatory mechanism which is sensitive to exhaust conditions, such as the reciprocatory percussive means disclosed in our U.S. Pat. No. 3,887,019.

Other features of the invention will be apparent from the following description, drawings and claims, the scope of the invention not being limited to the drawings themselves as the drawings are only for the purpose of illustrating a way in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENTS

Figure 1:
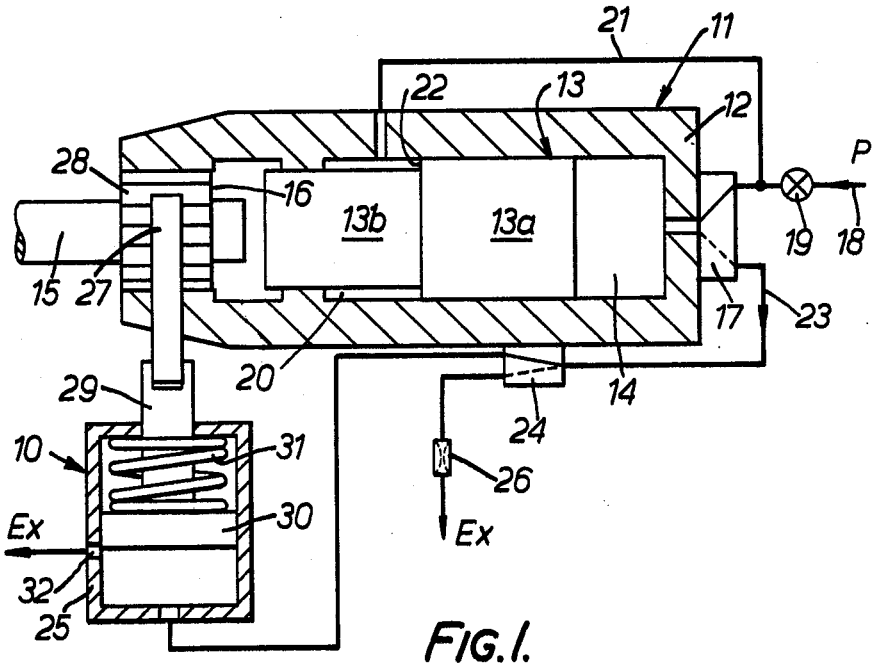
FIG. 1 illustrates one embodiment of the invention diagrammatically, in longitudinal section.

The hand-held percussive/rotary hammer illustrated diagrammatically in FIG. 1, apart from rotary drive means 10, is generally as disclosed in said U.S. Pat. No. 3,887,019 and the construction and operation of the reciprocatory percussive means 11 will only be described herein in a very general sense. The hammer comprises a body 12 housing a reciprocatory piston/-striker member 13 having a piston portion 13*a* and a striker portion 13*b*. The body defines a pressure chamber 14, the hydraulic pressure in which produces power strokes of the piston/striker member 13 which impacts on a tool steel 15 detachably held in a tool holder comprising a rotary bush 16 at one end of the body 12.

Alternate pressurisation and exhaust of the chamber 14 is controlled by an automatic cyclic valve 17 housed in the other end of the body 12, and this valve is supplied from a hydraulic pressure source through a supply hose 18. A manual on-off valve 19, also built into the body 12, controls the admission of pressure fluid to the hammer hydraulic circuit.

The body 12 also defines a pressure chamber 20 which, during operation of the hammer, is subject to the full hydraulic supply pressure through an internal conduit 21. This pressure acts on a differential area 22 of the piston/striker member 13 to produce the return strokes of the piston when the chamber 14 is connected to an exhaust outlet line 23 through the valve 17, the chamber 14 exhausting through the exhaust line 23 at a lower pressure than the supply pressure in the hose 18.

A manually-operable valve 24 mounted on the body 12 selectively directs the exhaust flow either to a cylinder 25 of a piston motor of the rotary drive means 10 or direct to source through a restrictor which is chosen to control the reciprocatory frequency of the hammer when the rotary drive is not required.

Figure 2:
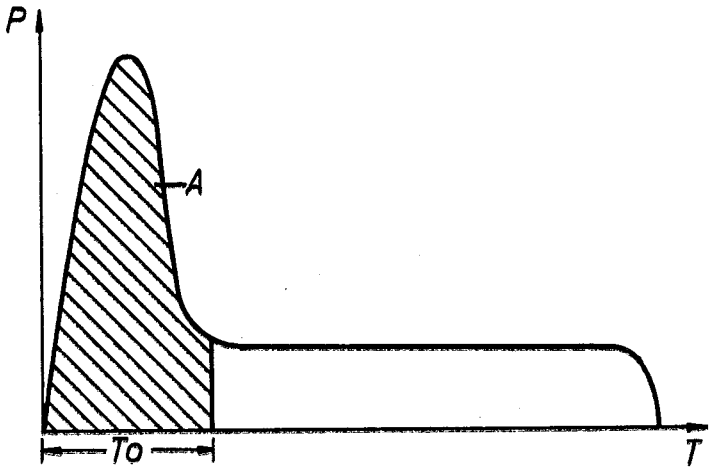
FIG. 2 illustrates graphically the exhaust pressure conditions during the return stroke of the reciprocating piston/striker of the embodiment of FIG. 1.

Referring now to the graph of FIG. 2, this shows a plot of exhaust pressure in the exhaust line 23 against time during a return stroke of the piston/striker member 13. This graph shows a pronounced initial peak as the striker portion 13*b* rebounds from the tool steel 15, and the shaded area A beneath this peak represents a considerable quantity of energy which is fed back into the hammer from the tool steel 15. Normally this energy has previously been wasted, and in the present invention is dissipated in the restrictor 26 when the rotary drive is not in operation. However, when the rotary drive is employed it utilises this normally wasted energy to rotate the bush 16, and hence the tool steel 15, in a stepwise fashion at the commencement of each return stroke to turn the tool cutting faces to a new position ready for the next forward cutting stroke. The angle through which the tool is rotated may, for example, be about 30° per stroke.

The stepwise drive for this bush 16 is provided by a pawl 27 which engages ratchet teeth 28 formed on the bush, and this pawl is connected to a piston rod 29 of a piston 30 of the piston motor. The piston 30 reciprocates in the cylinder 25, in the forward drive direction being moved by the exhaust pressure in the line 23 through the valve 24. The piston 30 is moved in the idle return direction by a return spring 31. Each forward stroke of the piston 30 is limited when the latter uncovers an exhaust port 32 in the cylinder 25, and this is positioned and the arrangement designed so that the piston motor displacement occupies approximately the time To (FIG. 2) corresponding to the shaded area A. In other words, the waste exhaust energy from the reciprocatory means 11 is utilised to operate the rotary means 10, whereas after the time To the reciprocatory means 11 exhausts freely and the presence of the rotary means 10 does not adversely affect the reciprocatory action. Thus the differential area 22 does not have to be increased to produce the piston member 13 return even though the exhaust flow is used to operate the rotary drive means 10. This is important as the efficiency of the hammer is related to the size of the return differential area 22 in an inverse sense.

The side face of the piston 30 or the wall of the cylinder 25 is provided with a small by-pass restrictor channel (not shown) which prevents the striker stalling should the rotary action jam momentarily. The size of the restriction provided by this channel also determines the proportion of the waste exhaust energy available which is actually converted to rotary motion. In general, the exhaust energy A available is considerably greater than that required for turning the tool steel 15 on the rebound strokes thereof. It will be appreciated that with hand-held devices the torque reduction which is thus achieved is of importance, as a man could not hold the device against the full torque normally available.

Figure 3:
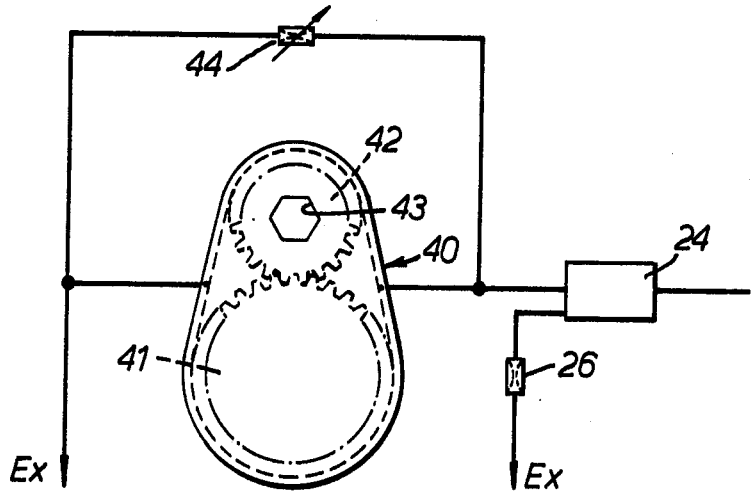
FIG. 3 illustrates diagrammatically the changed features of another embodiment.

The embodiment of FIG. 3 utilises the same basic hammer construction as the embodiment of FIG. 1, but in this case the rotary drive means comprise a rotary gear motor 40. This employs meshing gears 41 and 42 with the gear 42 replacing the rotary bush 16 of the first embodiment, the shank of the tool steel 15 being received in a hexagonal through bore 43 of the gear 42. The gear motor 40 is connected in an exhaust line from the valve 24 in the same way as the piston motor 10, but in this case a variable restrictor 44 is connected in parallel with the motor 40.

Thus the arrangement of FIG. 3 is more particularly suited to the device when intended for operation from a pressure gallery supply. In this case variation of the restrictor 44 not only affects the rotary power but also the percussive characteristics of the hammer, and enables the percussive and rotary energies to be proportioned. Thus, with the restrictor 44 fully open a maximum percussive frequency is achieved with a low torque and low speed of the rotary means. In contrast, with the restrictor 44 fully closed a minimum percussive frequency is achieved with a high torque and high speed of the rotary means. It will be appreciated that a variable restrictor can similarly be connected in parallel with the rotary drive means 10 of the first embodiment, in which case the by-pass channel described will normally be omitted.

Figure 4:
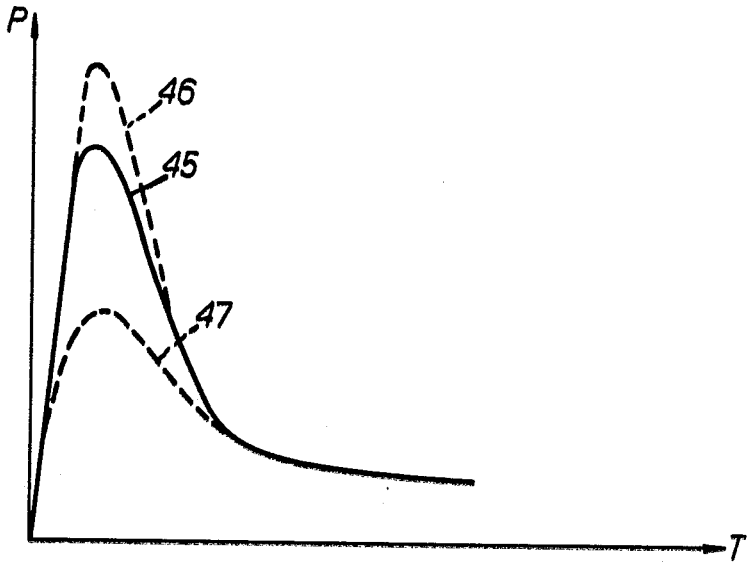
FIG. 4 illustrates, similarly to FIG. 2, the exhaust pressure conditions with said other embodiment.

FIG. 4 illustrates graphically the exhaust pressure characteristics with the variable restrictor 44 arrangement of FIG. 3. The full line 45 illustrates the exhaust pressure pulse with a typical mid-position adjustment of the restrictor 44. Broken line 46 illustrates the changed pulse for a maximum restriction, whereas broken line 47 illustrates the pulse for a minimum restriction by the restrictor 44.

I claim:

1. A rotary and percussive device comprising means for holding a tool, hydraulic reciprocatory percussive means adapted to impact the tool and having an inlet and an exhaust outlet, said inlet being adapted for connection to a hydraulic pressure supply and the percussive means exhausing through the exhaust outlet at a lower pressure than the supply pressure, and hydraulic rotary drive means adapted to rotate the tool and connected in series hydraulically with said reciprocatory percussive means, said rotary drive means being operated by hydraulic fluid supplied from said exhaust outlet.

2. A device according to claim 1, wherein valve means by which the rotary drive means can selectively be rendered operative or inoperative comprise a two-position valve having one position in which the valve directs the exhaust flow from the reciprocatory percussive means to the rotary drive means, and another position in which the valve by-passes the rotary drive means through a restrictor.

3. A device according to claim 1, comprising a flow restrictor arranged in parallel with the rotary drive means.

4. A device according to claim 3, wherein said flow restrictor is adjustable.

5. A device according to claim 1, wherein the rotary drive means comprises a piston motor.

6. A device according to claim 4 wherein said rotary drive means comprises a piston motor and wherein said flow restrictor is provided by a by-pass channel in the piston or a cylinder of the piston motor.

7. A device according to claim 5, comprising spring means by which the piston is returned towards one end of the piston motor cylinder, said end of the cylinder being connected to the exhaust side of the reciprocatory percussive means, and a port in the piston motor cylinder which is uncovered by the piston at the end of a power stroke thereof is connected to exhaust.

8. A device according to claim 5, wherein the rotary drive means includes a rotary bush which is adapted to receive a tool impacted by the percussive means the received tool is rotated, by said rotary bush and said rotary bush being driven by the piston motor through a ratchet mechanism.

9. A device according to claim 1, wherein the percussive device is of a type in which the percussive frequency thereof is determined by exhaust pressure conditions.

* * * * *